United States Patent [19]

Heggdal, deceased

[11] 4,007,558

[45] Feb. 15, 1977

[54] TURNABLE WINDOW ARRANGEMENTS

[75] Inventor: Bernhard Heggdal, deceased, late of Haramsoy, Norway, by Helene Heggdal, legal representative

[73] Assignee: Leif N. Austines, Haramsoy, Norway

[22] Filed: Jan. 29, 1976

[21] Appl. No.: 653,396

[30] Foreign Application Priority Data

Apr. 30, 1975 Norway ..... 751542

[52] U.S. Cl. ..... 49/252; 49/248

[51] Int. Cl.[2] ..... E05D 15/44

[58] Field of Search ..... 49/252, 250, 251, 253, 49/260, 248, 246

[56] References Cited

UNITED STATES PATENTS

| | | | |
|---|---|---|---|
| 2,362,730 | 11/1944 | Soulę | 49/252 |
| 2,648,878 | 8/1953 | Albano | 49/252 |
| 2,797,917 | 7/1957 | Lickteig, Jr. et al. | 49/250 X |
| 3,722,142 | 3/1973 | Anderberg et al. | 49/252 X |
| 3,918,205 | 11/1975 | Rasmussen | 49/252 |

*Primary Examiner*—Philip C. Kannan
*Attorney, Agent, or Firm*—Kenyon & Kenyon Reilly Carr & Chapin

[57] ABSTRACT

Turnable window arrangement with a casement connected to a window frame by means of two oppositely directed pivot pins at one end of the casement which is uppermost when the latter is in its normal closed position. The pivot pins slidably engage their respective associated guide grooves in the window frame to permit this one end of the casement to be displaced to selected pivotal positions between upper and lower ends of the frame. The pivot pins are also displaceable in the casement in a direction substantially parallel to the height dimension of the casement, namely parallel to the longitudinal axis of the vertical side portion of the casement. Link arm mechanisms are arranged on their respective opposite sides of the casement for the support of the latter in the window frame at the selected pivotal positions.

5 Claims, 3 Drawing Figures

Figure 1:
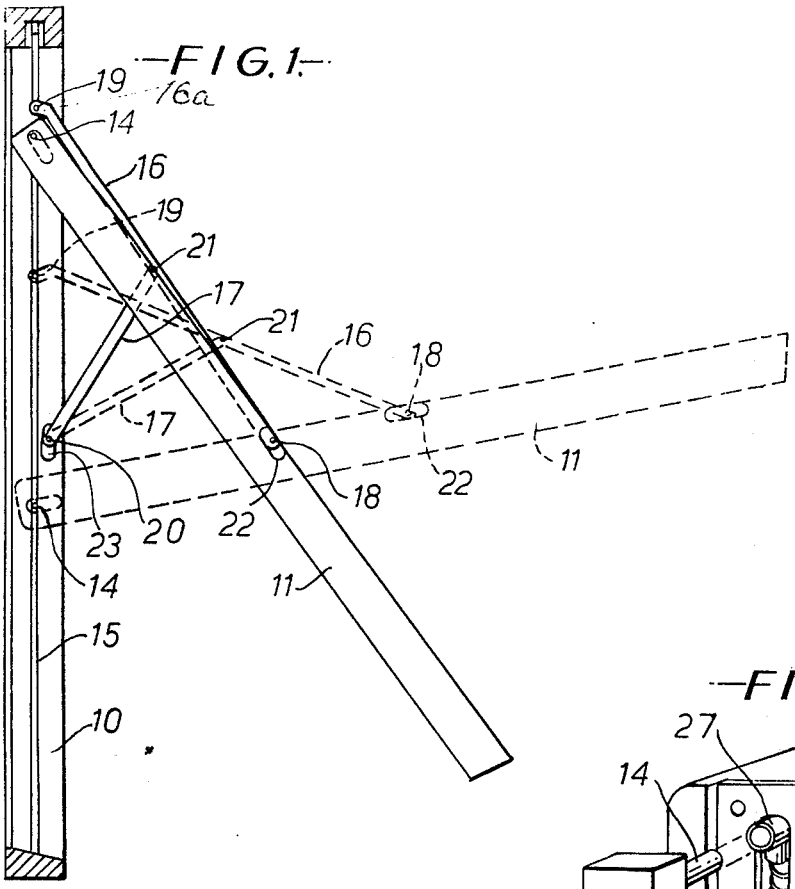

19
16a
14
16
19
21
17
21
16
18
17
11
22
18
23
20
22
14
11
15
10

27
14
25
26
11
15
28
15a 27
32
30
31
33
34
35
11

TURNABLE WINDOW ARRANGEMENTS

This invention relates to turnable window arrangements comprising a casement which is connected to a window frame by means of two oppositely directed pivot pins at one normally upper end of the casement which slidably engage their respective associated guide grooves in the frame so as to permit displacement of the said one end of the casement to desired positions in the frame together with link arm mechanisms which are arranged on their respective opposite sides of the casement and which are adapted to support the casement in differently desired pivotal positions in the window frame.

Several designs of link arm mechanisms for such turnable windows are known.

A window of the afore-mentioned type is, for example, shown in Norwegian Patent Specification No. 118,509 where each link arm mechanism consists of two arms, of which one end of a first arm is jointed to the central portion of the casement while its opposite end is slidably displaceable and pivotably mounted in a vertical groove in the window frame and the other arm has the one end jointed to the central portion of the first arm and the opposite end jointed to the window frame. The link arm mechanism can be modified in various ways, for example, as is shown in Norwegian Patent Application No. 750041. Other forms of link arm mechanisms have been proposed for turnable windows, for example, in Norwegian Patent Nos. 107,278 and 122,614.

It is desirable with turnable windows to achieve stabilisation of the casement in all the various, desired positions which the casement can occupy in the window frame. At the same time, it is desirable to be able to achieve pivoting of the casement to and from the said desired position in a ready manner, that is to say without having to exert a particularly large pivotal force and with a uniform sliding movement of the casement. In particular, problems can occur in pivoting the casement about the dead centre which is formed when the casement assumes a substantially horizontal position in the window frame. In practice, one has either had to choose a compromise solution or also one has had to solve certain geometrical fitting problems of the geometry of the link arm mechanism in each individual case, that is to say dependent upon the size and weight of the window.

In the present invention the objective is a solution in which the afore-mentioned problems can be largely avoided in a ready manner.

According to the present invention a turnable window arrangement comprises a window frame having a guide groove extending along each of two opposing sides between upper and lower ends thereof, a casement having a pair of oppositely directed pivot pins at an end thereof which is uppermost when said casement is in a normal closed position relative to said frame, said pivot pins being displaceable in said casement in a direction substantially parallel to the height dimension of said casement and slidably engaging said guide grooves to permit said end of said casement to be displaced to selected pivotal positions between said upper and lower frame ends, and a link arm mechanism arranged on opposite sides of said casement to support the latter in said frame at said pivotal positions.

In this way, during pivoting of the casement, the pivot pins can be relieved of pressure which is due to the weight of the casement or pressure which is transferred from the link mechanism and the pivot pins can thereby be permitted to slide relatively unhindered in the associated guide groove in the window frame by corresponding displacement of the pivot pins in the casement itself.

It is preferred that the pivot pin is displaceable in a direction from the normally upper end of the casement in which the pivot pin is arranged towards the opposite end of the casement, against the force of a spring.

Figure 2:
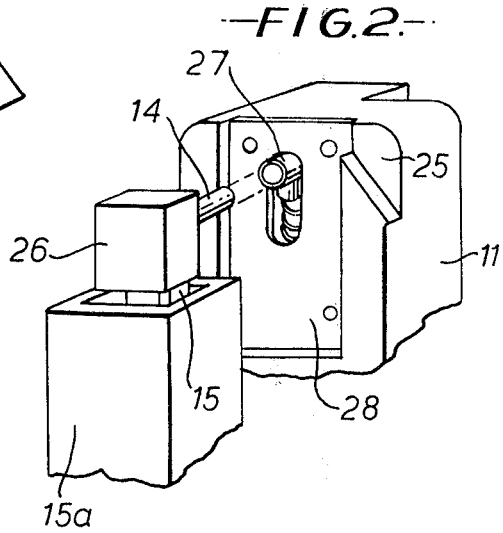
Figure 3:
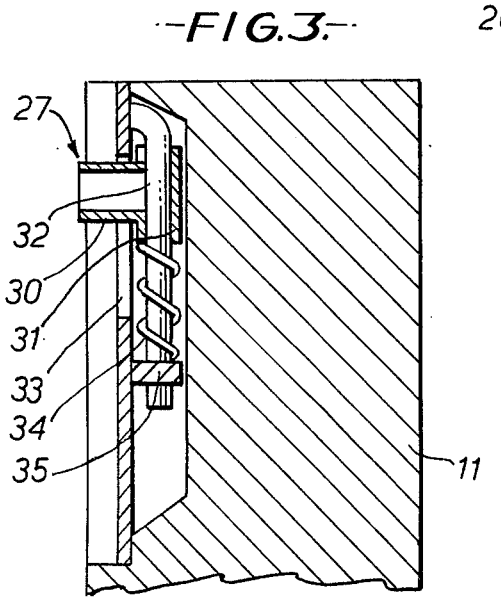

In order that the invention can be more clearly understood, convenient embodiments thereof will now be described, by way of example, with reference to the accompanying drawings in which:

FIG. 1 is a sectional view of a window with the casement illustrated in full lines in an airing position and in dash lines approximately in a horizontal position, FIG. 2 is a perspective view of a casement fitting in the arrangement according to the invention, and FIG. 3 is a longitudinal section of the casement fitting of FIG. 2.

Referring to FIG. 1, a window frame 10 has a casement 11 which is pivotable about a horizontal axis relative to the frame.

The casement 11 is equipped at the one end, which in the closed position of the window is arranged uppermost in the window, with a pair of oppositely directed, horizontal pivot pins 14 each of which engages with its respective vertical guide groove 15 in the frame 10. On displacement of the pivot pins laterally in the associated guide grooves 15, the said one end of the casement can be moved to desired positions in the window frame between upper and lower ends of the frame. The casement is pivoted about 180° from the closed position with the pivot pins arranged at the upper ends of the guide grooves, to the fully turned position with the pivot pins arranged at the lower ends of the guide grooves. In the fully turned position, the window is substantially closed with the outer side of the window directed inwards.

In order to be able to open and turn the casement in a readily controlled manner with the best possible stabilising support of the casement in the different positions between the fully closed and fully turned positions, there is utilised a link arm mechanism in the form of a pair of arms 16, 17 on vertical sides of the window frame for connection of the casement to the window frame.

A first arm 16 of the pair of arms has its one end pivotably mounted about a horizontal pin 18 on the casement 11 approximately at its horizontal central axis, so that in arbitrary positions the casement assumes a substantially stable pivoting position about the axis through the pins 18 of two corresponding arms 16 of the said pairs of arms. The opposite end of the arm 16 is provided with a horizontal outwardly directed support pin 19 which is received in sliding connection with an associated guide groove in the vertical side of the window frame 10.

A second arm 17 of the pair of arms has its one end pivotably mounted about a horizontal pin 20 on the window frame 10 approximately at its horizontal central axis. The opposite end of the arm 17 is provided with a horizontal outwardly directed pin 21 which is pivotably mounted approximately centrally of the arm 16. In the illustrated embodiment the distance between the pins 20 and 21 is equal to the distance between the pins 21 and 18.

The pins 18 and 20 are each secured to respective fittings 22 and 23 which are received in a respective opening in the casement 11 and the window frame 10. The arms 16 and 17 are mainly straight and in the closed position of the window, the arms 16 and 17 extend parallel in alignment with each other, the arm 16 being received in a gap between casement and window frame while the arm 17 is received in a longitudinally defined opening in the window frame 10.

A common guide groove 15 is utilised for the pivot pin 14 and the support pin 19. The guide groove is formed by a metal rail 15*a* (see FIG. 2) having a substantially C-shaped cross-section. The rail 15*a* projects inwards towards the light opening of the window to a plane tightly up under the adjacent peripheral side of the casement.

It is evident from FIG. 1 that the support pin 19 is arranged on the upper side of the pivot pin 14 and for this reason the arm 16 is provided at the upper end with an approximately L-shaped lug portion 16*a*. In the fully closed condition of the window, the arm 16 will thus extend parallel to the arm 17 and will extend rectilinearly over the greater portion of its length and will project laterally inwards over the rail 15*a* with the lug portion 16*a*. For this reason the lug portion 16*a* is also turned in a substantially S-shaped path away from the main plane of the arm 16 and a smaller opening 25 (see FIG. 2) is formed in the casement at its upper end. In the fully closed condition of the window the support pin is arranged in the illustrated embodiment at a level just above the top edge of the casement.

Referring to FIG. 2, the pivot pin 14 is secured to a sliding shoe 26 which together with the pivot pin substantially corresponds to the cross-sectional opening of the C-shaped rail profile in the rail 15*a*, but with a sufficient degree of movement between the sliding shoe 26 (and associated pivot pin 14) and the groove 15 in the rail 15*a*. The pivot pin is axially displaceably received in a bearing 27 in a fitting 28 fixed to the casement. This means that the casement can be displaced to a certain degree laterally relative to the pivot pins, as required. Furthermore, the pivot means are able to permit assembly and disassembly of the pivot pins in the casement at a suitably oblique position of the casement. Such an oblique position will, however, be excluded when the arms 16, 17 are in desired connection with frame and casement.

Referring to FIG. 3, the bearing 27 consists of a T-shaped pipe member. The stem portion 30 of the T-shape forms a guide for the pin 14 while the cross-piece 31 of the T-shape is slidably received on a bar 32 which is secured to the rear side of the fitting 28 and which extends parallel to a slot 33 in the fitting 28. The slot 33 extends in the height dimension of the casement, that is to say parallel to the longitudinal axis of the vertical portion of the casement, and has a length of a couple of cm. and a breadth substantially corresponding to the breadth of the stem portion 30.

Bearing 27 is maintained in position at the location shown in FIG. 2 by means of a compression spring 34 which is set up between the bearing 27 and a spring abutment 35 on the bar 32. In this way, one is able to ensure that the bearing is adjusted into a position as far as possible towards the normal upper end edge of the casement, while permitting a certain limited movement in a direction away from said end edge against the force of the compression spring in those circumstances where there is a need for it. By adjusting the force of the compression spring 34 as required — for example by regulating the fastening to the spring abutment 35 — the support abutment between casement and frame can be readily adjusted via the pins 14 in a desired manner so that unintentional slackness between casement and frame is avoided, at the same time as wedging of the casement in the frame in or by the horizontal position of the casement in the frame is avoided.

It is claimed:

1. A turnable window arrangement which comprises a window frame having a guide groove extending along each of two opposing sides between upper and lower ends thereof, a casement having a pair of oppositely directed pivot pins at an end thereof which is uppermost when said casement is in a normal closed position relative to said frame, said pivot pins being displaceable in said casement in a direction substantially parallel to the height dimension of said casement and slidably engaging said guide grooves to permit said end of said casement to be displaced to selected pivotal positions between said upper and lower frame ends, said pivot pins being displaceable in said casement from the uppermost end thereof towards its opposite end against resilient means, and a link arm mechanism arranged on opposite sides of said casement to support the latter in said frame at said pivotal positions.

2. The arrangement of claim 1, wherein fittings secured at the uppermost end of the casement are each formed with a slot and each comprises a bearing receiving its respective pivot pin and slidably mounted for controlled movement in said slot in the direction of said opposite end of said casement against the force of said resilient means urging said bearing against an end of said slot at said uppermost end of said casement.

3. The arrangement according to claim 2, wherein the pivot pins are axially displaceable in their respective bearings permitting lateral movement of said casement relative to said pins.

4. The arrangement of claim 3, wherein said fitting has a bar portion secured at its rear side extending parallel to the slot and formed with an abutment, the bearing being in the form of a T-shaped pipe member having a stem portion receiving the pivot pin and a cross-piece portion slidably received on said bar and the resilient means being in the form of a compression spring mounted around said bar to act between said bearing and said abutment.

5. The arrangement of claim 1, wherein each guide groove is defined by a rail of substantially C-shape and each pivot pin has secured at its outer end a sliding shoe, said shoe being received in said C-shape and said pivot pin passing through the opening to said C-shape in such a manner that a degree of movement is possible between said shoe with its associated pin and said groove.

* * * * *